United States Patent [19]

Brantly

[11] Patent Number: 4,534,168

[45] Date of Patent: Aug. 13, 1985

[54] PUMP JACK

[76] Inventor: Newby O. Brantly, 210 W. Highview, Frederick, Okla. 73542

[21] Appl. No.: 509,294

[22] Filed: Jun. 30, 1983

[51] Int. Cl.[3] ..... F04B 47/04; F15B 13/042

[52] U.S. Cl. ..... 60/369; 91/304; 91/314; 91/337; 91/338

[58] Field of Search ..... 60/369, 371, 372; 91/314, 304, 337, 338; 137/625.63, 625.66

[56] References Cited

U.S. PATENT DOCUMENTS

| | | | |
|---|---|---|---|
| 2,488,596 | 11/1949 | Hungate | 91/338 X |
| 2,699,154 | 1/1955 | Smith | 91/314 X |
| 2,887,955 | 5/1959 | Owen | 91/314 X |
| 2,972,863 | 2/1961 | Hyde | 60/372 |
| 2,977,040 | 3/1961 | Dulebohn et al. | 91/338 X |
| 3,164,325 | 1/1965 | Veum | 91/314 X |
| 3,369,490 | 2/1968 | Hawk | 60/372 X |
| 4,066,239 | 1/1978 | Hall | 137/625.63 X |
| 4,346,620 | 8/1982 | Stanton | 60/369 X |
| 4,374,485 | 2/1983 | Lattuada | 137/625.66 X |

*Primary Examiner*—Irwin C. Cohen
*Attorney, Agent, or Firm*—Dunlap & Codding

[57] ABSTRACT

A pump jack having a walking beam oscillated in a vertical arc by a hydraulic actuating cylinder that receives pressurized hydraulic fluid from a variable displacement pump. The hydraulic actuating cylinder is controlled by a hydraulic valve having an operating member mechanically shifted by a second hydraulic actuating cylinder near the end points of the pivotation arc of the walking beam to reverse the direction of movement of the walking beam during the shifting of the operating member of the hydraulic valve. The second hydraulic actuating cylinder is controlled by a second hydraulic valve that transmits pressure to the second hydraulic actuating cylinder from the variable displacement pump and reverses the flow of pressurized hydraulic fluid to the ports of the second hydraulic actuating cylinder near the end points of the pivotation arc of the walking beam.

8 Claims, 9 Drawing Figures

PUMP JACK

CROSS REFERENCE TO RELATED APPLICATION

The subject matter of the present application is related to the subject matter discussed in my U.S. patent application entitled "Apparatus For Powering A Surface Deployed Oilwell Pumping Unit", Ser. No. 405,890, filed Aug. 6, 1982, and now abandoned.

BACKGROUND OF THE INVENTION

1. Field of the Invention

The present invention relates generally to improvements in oil well pumping units and more particularly, but not by way of limitation, to improvements in pump jacks used to operate downhole pumps connected to a horsehead of the pump jack via a polish rod and sucker rods extending down the well to the pump.

2. Description of the Prior Art

A common system for pumping an oil well is to provide a pump jack on the earth's surface, adjacent the well, to operate a downhole pump; that is, a pump that is located in the well and connected to the pump jack via a plurality of sucker rods extending upwardly to a polish rod that is connected to the pump jack. In a system of this type, the pump jack includes a walking beam that is pivotally mounted atop a samson post, forming a part of a pump jack base, and the walking beam is oscillated in a vertical arc to alternately raise and lower a horsehead mounted on one end of the walking beam. The polish rod is connected to the horehead so that the oscillation of the walking beam is translated into a reciprocation of the polish rod that is transmitted to the pump via the sucker rods to operate the pump.

A variety of drive systems, each having its own advantages and disadvantages, can be used to oscillate the walking beam. In many respects, a particularly advantageous system is one in which a hydraulic actuating cylinder is connected between the walking beam and the pump jack base so that the piston rod of the hydraulic actuating cylinder can be alternately extended and retracted, under the control of a suitable hydraulic circuit, to oscillate the walking beam. As has been discussed in my aforementioned co-pending application, a major advantage of such a system is that it offers possibilities for easily adjusting the stroke and reciprocation rate of the polish rod, to meet existing conditions at a well, that cannot be matched with other types of systems for oscillating the walking beam. However, such pump jack systems are not without problems. In particular, for efficient and substantially trouble-free operation of a pumping system using a pump jack, it is desirable that the walking beam of the pump jack undergo motion that is substantially harmonic; that is, motion in which the speed of the walking beam slowly decreases, and subsequently slowly increases in an opposite direction, near the end points of its arc of travel while the walking beam moves at a relative high speed through the center of such arc. A problem which has not been solved in prior art pump jacks is that of causing the walking beam of a pump jack utilizing a hydraulic actuating cylinder drive system to undergo such motion, especially without unduly increasing the cost of construction of the pump jack, or forfeiting other advantages that pump jacks of this type can have, or both. The present invention solves this problem.

SUMMARY OF THE INVENTION

The present invention provides a pump jack in which the walking beam is oscillated by a hydraulic actuating cylinder in a manner such that the walking beam of the pump jack undergoes substantially harmonic motion. In particular, the pump jack of the present invention includes a walking beam that is mounted on a pump jack base for oscillation in a vertical arc between selected end positions of the walking beam in its pivotation on a pump jack base and the walking beam is oscillated between these end positions by a hydraulic actuating cylinder that receives pressurized hydraulic fluid from a novel hydraulic control circuit. Such control circuit establishes a transition interval for the walking beam adjacent each end point of the arc of pivotation of the walking beam and, within each transition interval, supplies pressurized hydraulic fluid to the hydraulic actuating cylinder at a flow rate proportional to the displacement of the walking beam from the end position from which such interval is established. Between the transition intervals, the control assembly supplies pressurized hydraulic fluid to the ports of the hydraulic actuating cylinder at a substantially constant flow rate.

In a preferred embodiment of the invention, such intervals are established by operating the hydraulic actuating cylinder through a first hydraulic valve that switches delivery of pressurized hydraulic fluid from one port of the hydraulic actuating cylinder to the other port thereof as an operating member of the first valve is moved between first and second end positions of the operating member. Such movement is effected using a second hydraulic actuating cylinder that is controlled by a second hydraulic valve having an operating member that is mechanically coupled to the walking beam.

At the time the walking beam reaches a transition interval, the operating member of the first valve will be in one of the two end positions and the piston rod of the second hydraulic actuating cylinder will be at one end of its range of travel. As the walking beam enters the interval, the second hydraulic valve establishes fluid flow to the second hydraulic actuating cylinder to commence driving the piston rod toward the other end of its range of travel so that the operating member of the first valve is driven toward the other of its end positions. The first hydraulic valve is selected to be a proportioning valve; that is, such valve delivers no hydraulic fluid to the hydraulic actuating cylinder attached to the walking beam at a neutral position of its operating member, midway between the end positions, and delivers hydraulic fluid to one or the other of the ports of such hydraulic actuating cylinder in proportion to the displacement of the operating member of the valve from the neutral position, the port to which the delivery occurs being determined by the direction the operating member is displaced from the neutral position. Thus, as the operating member of the first hydraulic valve is moved away from the end position at which it is disposed as the walking beam enters the transition interval, the delivery rate of pressurized hydraulic fluid to the hydraulic actuating cylinder that oscillates the walking beam is slowed to slow the walking beam, the walking beam coming slowly to rest as the operating member of the first valve reaches the neutral position midway between its end positions. The operating member of the first valve is coupled to the piston rod of the second hydraulic actuating cylinder such that the piston rod will reach the midpoint of its range of travel as the operating member of the first valve reaches the neutral position so that the piston rod of the second hydraulic actuating cylinder will continue moving after the walking beam comes to rest to continue driving the operating member toward the other of the end positions thereof. Thus, the first hydraulic valve will commence delivering pressurized hydraulic fluid to the hydraulic actuating cylinder that oscillates the walking beam to cause the walking beam to begin moving back through the transition interval. Moreover, because of the proportioning characteristic of the first hydraulic valve, such delivery is at an ever increasing rate to accelerate the walking beam smoothly from rest as it traverses the transition interval. At the end of the transition interval, the operating member of the first hydraulic valve will again have reached an end position and the piston rod of the second hydraulic valve will have reached an end point of its range of travel so that further adjustment of the flow rate of pressurized hydraulic fluid to the hydraulic actuating cylinder that oscillates the walking beam is discontinued and the walking beam will commence movement at a substantially constant speed as it leaves the transition interval. Such motion of the walking beam continues until the walking beam reaches the transition interval of the opposite end of its arc of travel wherein it is again smoothly brought to rest and then smoothly accelerated with a reversal of its direction of motion.

An object of the present invention is to provide a pump jack in which the walking beam undergoes substantially harmonic motion.

Another object of the present invention is to provide a pump jack in which substantially harmonic motion of the walking beam is achieved while oscillating the walking beam with a hydraulic actuating cylinder.

Yet a further object of the present invention is to provide a pump jack in which the walking beam undergoes substantially harmonic motion at a relatively low cost of construction.

Another object of the invention is to achieve substantially harmonic motion for a walking beam of a pump jack while retaining advantages inherent in the operation of the pump jack via a hydraulic actuating cylinder that oscillates the walking beam.

Other objects, advantages and features of the pump jack of the present invention will become clear from the following detailed description of the preferred embodiment of the invention when read in conjunction with the drawings and appended claims.

BRIEF DESCRIPTION OF THE DRAWINGS

FIG. 8 is a schematic circuit diagram of the hydraulic control circuit.

FIG. 9 is a graphical representation of the operation of the components of the hydraulic control circuit and the first hydraulic actuating cylinder of the pump jack as a function of time during the oscillation of the walking beam.

DESCRIPTION OF THE PREFERRED EMBODIMENT

Figure 1:
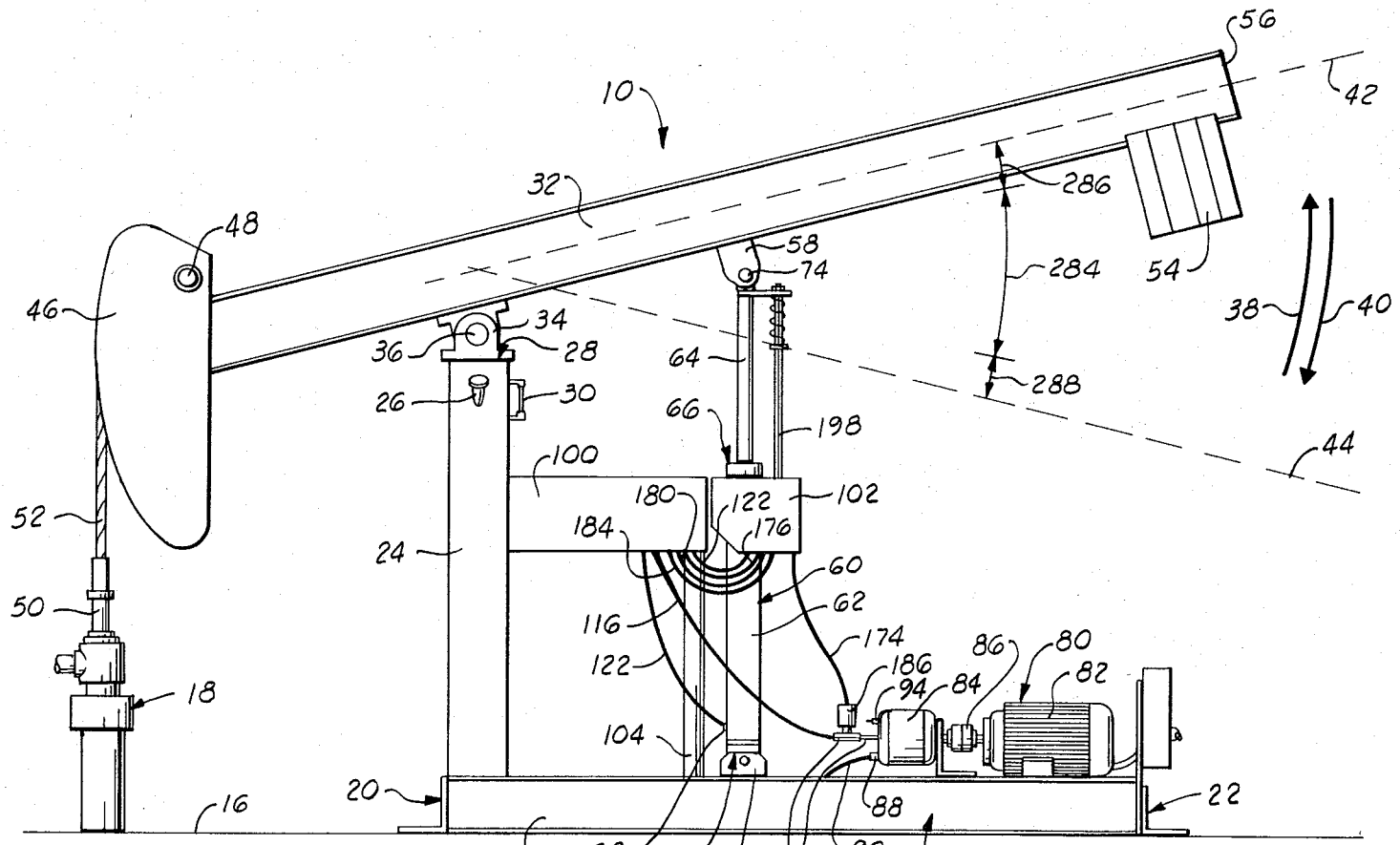
FIG. 1 is a side elevational view of a pump jack constructed in accordance with the present invention.

Referring now to the drawings in general and to FIG. 1 in particular, shown therein and designated by the general reference numberal 10 is a pump jack constructed in accordance with the present invention. The pump jack 10 comprises a pump jack base 12, including a skid 14 that can be positioned on the earth's surface 16 adjacent a well, generally indicated at 18 in FIG. 1, that is to be pumped using the pump jack 10.

The skid 14 is a conventional frame structure having a forward end 20 positioned to face the well 18 during pumping operations and a rear end 22 that faces away from the well 18. The pump jack base 12 further comprises a samson post 24 which is connected to the forward end 20 of the skid 14 and extends upwardly therefrom. In the preferred embodiment of the invention, the samson post 24 is an elongated, hollow structure so that the samson post 24 can be filled with a fluid to serve as a reservoir for hydraulic circuitry to be discussed below. To this end, a fill port 26 is provided near the upper end 28 of the samson post 24 to permit the introduction of hydraulic fluid into the samson post 24 and a conventional sight glass 30 can be mounted on the samson post 24 to permit visual inspection of the level to which the samson post 24 is filled with hydraulic fluid.

The pump jack 10 further comprises a walking beam 32 pivotally mounted on the pump jack base 12 via a conventional pivot connector 34 secured to the upper end 28 of the samson post 24 to permit the walking beam 32 to be pivoted in a vertical arc about a pin 36 forming a portion of the connector 34. In particular, during operation of the pump jack 10, the walking beam 32 is alternately pivoted in first and second directions, 38 and 40 respectively, so that the walking beam 32 oscillates between a first end position in which the longitudinal midsection of the walking beam 32 extends along the dashed line 42 in FIG. 1 and a second end position in which the longitudinal midsection of the walking beam 32 extends along the dashed line 44 in FIG. 1. As will be discussed below, and for a purpose also to be considered below, the locations of the end positions of the walking beam 32 can be selectively varied to adjust the extent of the pivotation arc of the oscillation of the walking beam 32 on the samson post 24.

At the end of the walking beam 32 nearest the well 18, the walking beam 32 carries a conventional horse head 46, pivotally secured to the walking beam 32 via a conventional pin connection 48, and the horse head 46 is connected to a polish rod 50 of the well 18 via a conventional cable connector 52. The polish rod is connected to a conventional downhole pump (not shown), via sucker rods (not shown) connected to the polish rod, so that the well 18 can be pumped by the oscillation of the walking beam 32. It will thus be seen that the stroke of the downhole pump can be varied by selecting the end positions of the pivotation arc of the walking beam 32. A plurality of plates forming a counterweight 54 can be mounted on the walking beam 32 near the end 56 thereof remote from the horse head 46 to counterbalance the static load on the horse head 46 in a conventional manner. Between the pivot connector 34 and the remote end 56 of the walking beam 32, the walking beam 32 is provided with a U-shaped bracket 58 to permit connection of a first hydraulic actuating cylinder 60 to the walking beam 32.

The first hydraulic actuating cylinder 60 is of conventional construction; that is, the first hydraulic actuating cylinder 60 comprises a cylinder portion 62, a piston rod 64 telescopically received in the upper end 66 of the cylinder portion 62 and a piston (not shown) attached to the lower end of the piston rod 64 within the cylinder portion 62 so that the piston rod 64 can be extended from the cylinder portion 62 by introducing pressurized hydraulic fluid into a first fluid port 68 of the first hydraulic actuating cylinder, the first fluid port 68 opening into lower portions of the cylinder portion 62, and the piston rod 64 can be retracted by introducing pressurized hydraulic fluid into a second fluid port 70 (FIG. 4) of the first hydraulic actuating cylinder, the second fluid port opening into upper portions of the cylinder portion 62. The extensive end of the piston rod 64 carries a tubular bearing 72 (FIG. 4) that fits within the bracket 58 so that the piston rod 64 can be pivotally attached to the walking beam 32 via a pin 74 that extends through the bearing 72 and into apertures (not numerically designated in the drawings) formed in the bracket 58. The lower end 76 of the cylinder portion 62 of the first hydraulic actuating cylinder 60 is similarly pivotally connected to central portions of the skid 14 as has been indicated at 78 in FIG. 1.

During operation of the pump jack 10, the walking beam 32 is oscillated between the selected first and second end positions of its pivotation arc by alternately introducing pressurized hydraulic fluid into the first and second fluid ports 68, 70 and the pump jack 10 includes a pumping assembly, generally designated 80 in FIG. 1, to provide a source of pressurized hydraulic fluid for the operation of the pump jack 10. The pumping assembly 80 is comprised of a constant speed electric motor 82 and a hydraulic pump 84 that is mechanically connected to the motor 82 via a coupling 86 so that the pump is operated by the operation of the motor 82. The pump 84 has a suction port 88 which is fluidly connected to a port (not shown) in the lower end of the samson post 24 via a conduit 90 and a pressure port 92 from which hydraulic fluid is discharged under pressure from the pump 84. Preferably, the pump 84 is a variable displacement pump having a swash plate (not shown) that can be positioned within the body of the pump 84, via a control knob 94, so that the pump 84 delivers pressurized hydraulic fluid to a tee 96 at a constant, selectable flow rate. The purpose of the tee 96 and the recited characteristics of the pump 84 will become clear below.

The pump jack 10 further comprises a hydraulic control circuit 98 which has been schematically illustrated in FIG. 8 and which is conveniently disposed within sheet metal compartments 100, 102 mounted, respectively, on the samson post 24 and the first hydraulic actuating cylinder 60. The compartment 100 is supported above the skid 14 by a brace 104 and the walls of the compartment 100 serve to provide a support on the pump jack 10 for a first mounting plate 106 (FIGS. 3 and 4) used to mount and operatively connect selected components of the hydraulic control circuit 98 as will be discussed below. Similarly, remaining components of the hydraulic control circuit 98 are mounted on a second mounting plate 108 (FIGS. 4–7) that is welded to the cylinder portion 62 of the first hydraulic actuating cylinder 60, as shown in FIG. 4, and forms an upper end wall of the compartment 102. (Suitable walls of the compartments 100, 102 can be removed to provide access to the components therein in a conventional manner that has not been illustrated in the drawings and the bottoms of the compartments 100, 102 can be left open to permit hydraulic connections to be made to components of the hydraulic control circuit 98 disposed within the compartments 100, 102.) As can be seen from the connection of the first hydraulic actuating cylinder 60 between the pump jack base 12 and the walking beam 32, the mounting of the compartment 102 on the first hydraulic actuating cylinder 60 will position the second mounting plate 108 below a portion of the walking beam 32 for a purpose that will become clear below.

Figure 2:
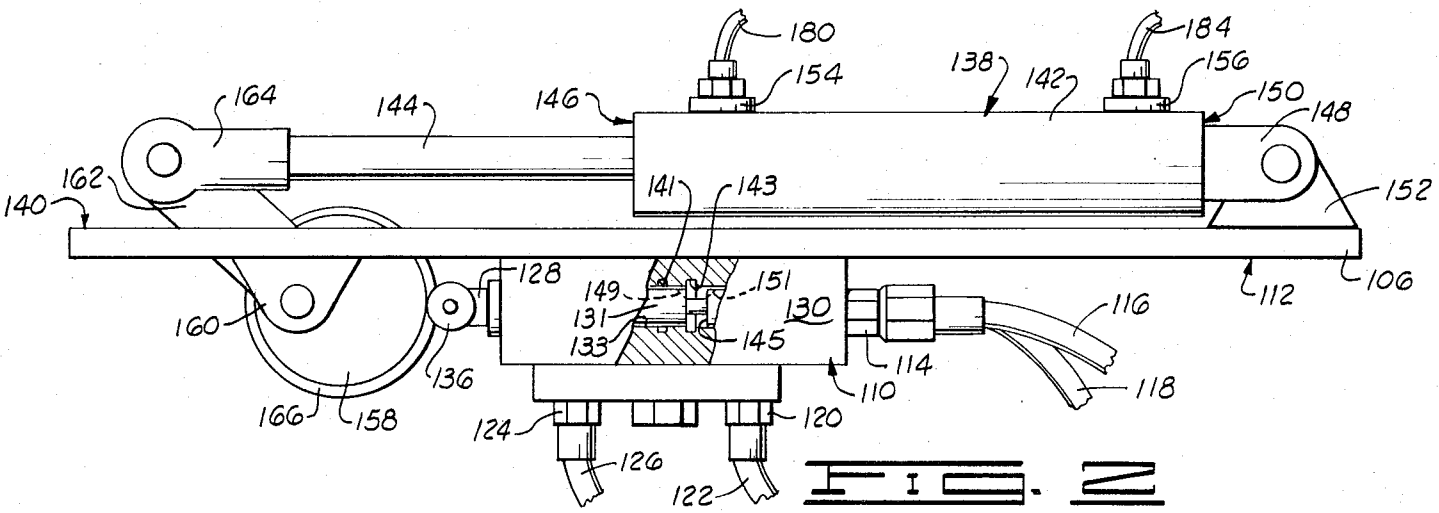
FIG. 2 is a side elevational view in partial cross section illustrating the coupling of the first hydraulic valve of the hydraulic control circuit to the second hydraulic cylinder of the control circuit.
Figure 3:
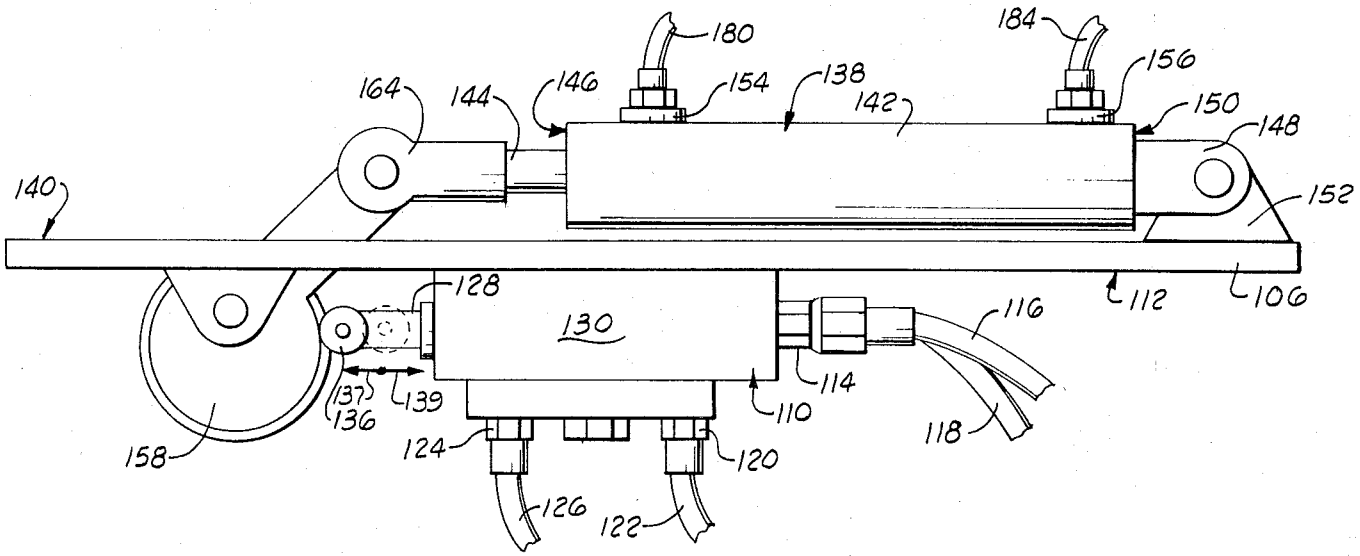
FIG. 3 is a side elevational view similar to FIG. 2 illustrating a second configuration of the first hydraulic valve and second hydraulic actuating cylinder.
Figure 4:
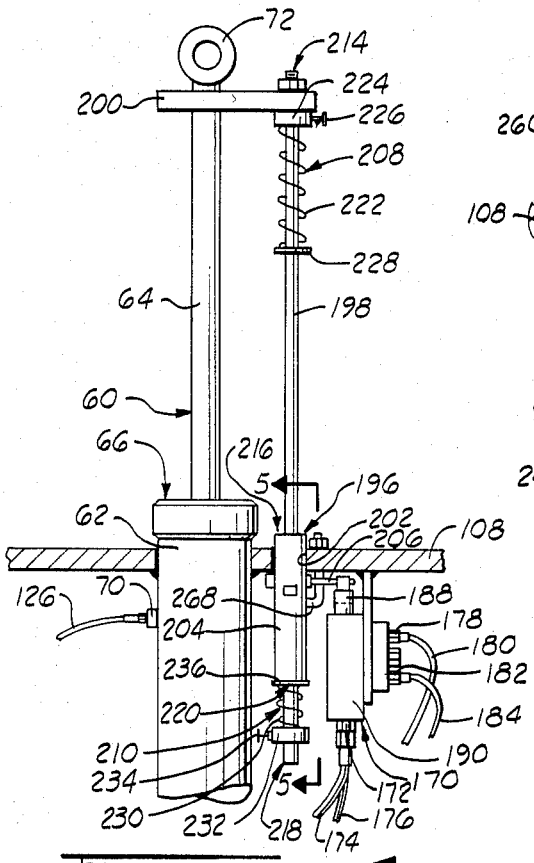
FIG. 4 is a side elevational view of the second hydraulic actuating cylinder operating assembly of the hydraulic control circuit.

Referring now to FIGS. 2, 3 and 8, the hydraulic control circuit 98 includes a first hydraulic valve 110 which is bolted to the underside 112 of the first mounting plate 106. The first hydraulic valve 110 is a 4-way valve having an input port 114 which is fluidly connected, via a hydraulic conduit 116 and the tee 96, to the pressure port 92 of the pump 84 and an exhaust port (not shown in the drawings) that is connected via a conduit 118 and a check valve 119 (FIG. 8) to a port (not shown) on the samson post 24 so that fluid exhausted from the exhaust port of the first hydraulic valve 110 is returned to the reservoir provided by the above-described construction of the samson post 24. (As will be discussed below, the input and exhaust ports of the first hydraulic valve become fluidly connected, internally of the valve 110, during portions of the operating cycle of the pump jack 10. The check valve 119 maintains pressure at the pressure port 92 of the pump 84 during such portions of the pump jack operating cycle for operating portions of the hydraulic circuit 98 that will be described below.) In addition, the first hydraulic valve 110 has a first outlet port 120 which is fluidly connected to the first fluid port 68 of the first hydraulic actuating cylinder 60, via a conduit 122 (see also FIG. 1), and a second output port 124 which is fluidly connected to the second fluid port 70 of the first hydraulic actuating cylinder 60 via a conduit 124 (see also FIG. 4).

The first hydraulic valve 110 is selected to have particular characteristics which make the valve 110 suitable for use in the hydraulic control circuit 98 as will now be discussed. Initially, the valve 110 is chosen to be mechanically actuable via an operating member 128 thereof that moves, relative to the case 130 of the valve 110, between an extended, or first, position shown in FIG. 3 and a retracted, or second, position shown in FIG. 2. Internally of the case 130, the valve 110 includes a spool 131, of which the operating member 128 is an extension, having a first section schematically indicated at 132 in FIG. 8 that fluidly connects the input port 114 of the valve 110 to the first output port 120 thereof, while fluidly connecting the exhaust port of the valve 110 to the second output port 124 thereof, when the operating member is in the first position shown in FIG. 3, and having a second section schematically indicated at 134 in FIG. 8 that fluidly connects the input port 114 to the second output port 124, while fluidly connecting the exhaust port to the first output port 120, when the operating member 128 is in the second position shown in FIG. 2. Midway between these positions, as indicated in dashed lines for a roller 136 mounted on the extensive end of the operating member 128, the operating member 128 has a neutral position in which fluid flow through the valve 110 is between the input port 114 and the exhaust port. With respect to the neutral position, it will be seen that the operating member 128 of the first hydraulic valve 110 is moved in a first direction 137 (FIG. 3) to connect the input port 114 to the first output port 120 and in a second direction 139 to connect the input port 114 to the second output port 124. For a purpose that will become clear below, the valve 110 is constructed to vary the flow of pressurized hydraulic fluid from the input port 114 to the first output port 120 in proportion to displacement of the operating member 128 in the first direction 137 from the neutral position of the operating member 128 and, similarly, to vary the flow of pressurized hydraulic fluid from the input port 114 to the second output port 124 in proportion to displacement of the operating member 128 in the second direction 139 from the neutral position of the operating member 128. Such characteristics can conveniently be achieved by modifying a conventional tandem center four-way spool valve in a manner indicated in cutaway detail in FIG. 2. As shown in such Figure, the spool 131 of the valve 110 is contained within a bore 133 formed through the case 130 and circumferential grooves 141, 143 are formed in medial portions of the bore 133 about the spool 131. One of the grooves 141, 143 is connected internally of the case 130 to the input port 114 and the other of the grooves 141, 143 is similarly internally connected to the exhaust port of the valve 110. Similarly, a circumferential groove 145 is formed in central portions of the spool 131 to fluidly connect the grooves 141, 143 in the neutral position of the operating member 128 to provide the tandem center mode of operation of the valve 110 that has been indicated by the central section 147 of the schematic representation of the valve 110 in FIG. 8. The modification of the spool 131 that provides the proportioning characteristics described above resides in axial grooves 149, 151 indicated in dotted lines in FIG. 1. Such grooves intersect the circumferential groove 145 in the spool 131 at which point the grooves 149, 151 have their greatest depth in the spool 131. (For clarity of illustration, the depths of the grooves 145, 149, 151 have been exaggerated in the drawings.) The grooves then slope away from the groove 145 toward the periphery of the spool 131, the grooves 194 and 151 terminating a distance from the groove 145 slightly less than the distance separating the grooves 141, 147 in the case 130. Thus, when the operating member 128 is in one of the end positions thereof, as indicated for the second position in FIG. 2, the grooves 149 and 151 will fluidly communicate with only one of the grooves 141, 143. However, as the operating member 128 is shifted away from one of the end positions, one of the grooves 149, 151 (groove 149 in FIG. 2) will provide fluid communication between the grooves 141 and 143 so that a portion of the hydraulic fluid supplied to the input port 114 is directed to the exhaust port of the valve. Because of the varying depths of the grooves 149, 151, such diverted portion of the supplied hydraulic fluid increases as the operating member 128 nears the neutral position thereof to provide the proportioning characteristic of the first hydraulic valve 110 described above. In addition, the first hydraulic valve 110 is also preferably of the type in which the operating member 128 thereof is mechanically biased, internally of the case 130, toward the first, or extended, position of the operating member 128 to facilitate actuation of the first hydraulic valve 110 by a second hydraulic actuating cylinder 138 which is mounted on the upper side 140 of the first mounting plate 106 as shown in FIGS. 2 and 3.

Like the first hydraulic actuating cylinder 60, the second hydraulic actuating cylinder 138 is of conventional construction, the second hydraulic actuating cylinder 138 having a cylinder portion 142, a piston (not shown) slideably positioned in the cylinder portion 142, and a piston rod 144 that is attached to the piston for telescopic movement into and out of a forward end 146 of the cylinder portion 142. The second hydraulic actuating cylinder 138 is mounted on the first mounting plate 106 via a bracket 148 on the rear end 150 of the cylinder portion 142 that is pinned to a lug 152 welded to the upper side 140 of the first mounting plate 106. A first fluid port 154 provides fluid communication into portions of the cylinder portion 142 of the second hydraulic actuating cylinder 138 near the forward end 146 of the cylinder portion 142 so that the piston rod 144 can be retracted via pressurized hydraulic fluid introduced into the first fluid port 154. Similarly, a second fluid port 156 near the rear end 150 of the cylinder portion 142 of the second hydraulic actuating cylinder 138 permits pressurized hydraulic fluid to be introduced into the cylinder portion 142 of the second hydraulic actuating cylinder to extend the piston rod 144 from the forward end 146 of the cylinder portion 142 of the second hydraulic actuating cylinder 138.

The piston rod 144 of the second hydraulic actuating cylinder 138 is mechanically coupled to the operating member 128 of the first hydraulic valve 110 via a cam 158 which is pivotally mounted on the first mounting plate 106 via a clevis 160 (only one of two parallel portions of the clevis 160 has been illustrated in the drawings) that is welded to the underside 112 of the first mounting plate 106 in front of the operating member 128 of the valve 110. The cam 158 is generally circular in form and has a radially extending arm 162 that passes through a slot (not shown) in the first mounting plate 106 to a clevis 164, mounted on the piston rod 144, to which the arm 162 is pivotally connected for pivotation of the cam 158 by extension and retraction of the piston rod 144 of the second hydraulic actuating cylinder 138. As shown in FIGS. 2 and 3, the cam 158 is mounted off-center such that the cam 158 will engage the roller 136 on the operating member 128 of the first hydraulic valve 110 when the piston rod 144 is extended, by introducing pressurized hydraulic fluid into the second fluid port 156 of the second hydraulic actuating cylinder 138, and force the operating member 128 to the second position thereof shown in FIG. 2. Similarly, when the piston rod 144 is retracted, by introducing pressurized hydraulic fluid into the first fluid port 154 of the second hydraulic actuating cylinder 138, the off-center mounting of the cam 158 permits the operating member 128 of the first hydraulic valve 110 to extend to the first position thereof shown in FIG. 3. The circular configuration of the cam 158, and the off-center mounting of the cam 158 on the first mounting plate 106, establishes a substantially linear relationship between the position of the piston rod 144 of the second hydraulic actuating cylinder 138 and the position of the operating member 128 of the first hydraulic valve 110 so that the neutral position of the operating member corresponds to a vertical position, as would be seen in FIGS. 2 and 3 of the drawings, of the arm 162. The coupling between the hydraulic actuating cylinder 138 and the operating member 128 of the valve 110 is stabilized via a two-part construction of the roller 136, one part of the roller being mounted to either side of the operating member 128, and grooves formed circumferentially in the periphery of the cam 158, on either side thereof, to accept portions of each of the two parts of the roller 136. (Only one such groove, designated 166, has been illustrated in the drawings and, similarly, only one part of the roller 136 has been illustrated.)

In addition to the first hydraulic valve 110 and the second hydraulic actuating cylinder 138, the hydraulic control circuit 98 further comprises a second hydraulic actuating cylinder operating assembly which taps into the flow of pressurized hydraulic fluid from the pump 84 to operate the second hydraulic actuating cylinder 138 during portions of the pivotation arc of the walking beam 32 as will be discussed below. The second hydraulic actuating cylinder operating assembly has been schematically illustrated in FIG. 8, and designated by the numeral 168 therein, and components of the second hydraulic actuating cylinder operating assembly 168 have been illustrated in FIG. 1 and FIGS. 4–7.

Referring first to FIG. 4, the second hydraulic actuating cylinder operating assembly 168 comprises a second hydraulic valve 170 having: an input port 172, which is fluidly connected to the pressure port 92 of the pump 84 via a conduit 174 (see also FIG. 1) and the tee 96 so that the port 172 is upstream of the check valve 119 as indicated in FIG. 8; an exhaust port (not shown) fluidly connected to a port (not shown) into the samson post 24 via a conduit 176 for discharging hydraulic fluid from the second hydraulic valve 170 into the reservoir formed by the samson post 24; a first output port 178, fluidly connected to the first fluid port 154 of the second hydraulic actuating cylinder 138 via a conduit 180; and a second output port 182, fluidly connected to the second fluid port 156 of the second hydraulic actuating cylinder 138 via a conduit 184. The second hydraulic actuating cylinder operating assembly 168 also comprises an orifice 186, shown in FIG. 1, that is interposed in the fluid connection between the pressure port 92 of the pump 84 and the input port 172 of the second hydraulic valve 170, at the tee 96, to regulate fluid flow between the pump 84 and the second hydraulic valve 170 for a purpose to be described below.

Like the first hydraulic valve 110, the second hydraulic valve 170 is a mechanically operated, four-way valve having an operating member 188 that can be extended or retracted, relative to a case 190 of the valve 170, to provide alternative internal fluid connections between the output ports of the valve 170 and the input and exhaust ports thereof. In particular, the second hydraulic valve 170 has a spool (not shown) attached to the operating member 188 internally of the case 190, the spool having a first section, schematically indicated at 192 in FIG. 8, to fluidly connect the input port 172 to the first output port 178 while fluidly connecting the exhaust port to the second output port 182 and a second section, schematically indicated at 194 in FIG. 8, to fluidly connect the input port 172 to the second output port 182 while fluidly connecting the exhaust port to the first output port 178. (During the operation of the pump jack 10, the second hydraulic valve 170 is moved rapidly between extended and retracted positions of the operating member 188 thereof so that the valve 170 can be any conventional four-way valve; for example, the valve 170 can be a blocked center valve as indicated in FIG. 8.) For a purpose that will become clear below, the output ports are selected to connect the input and exhaust ports to the output ports via the second section 194 when the operating member 188 of the second hydraulic valve 170 is in an extended, or second, position shown in FIG. 4 and to connect the input and exhaust ports to the output ports via the first section when the operating member 188 is in a retracted, or first, position indicated by the dotted line across the operating member 188 in FIG. 4.

In addition to the second hydraulic valve 170 and the orifice 186, the second hydraulic actuating cylinder operating assembly 168 comprises a second hydraulic valve control assembly designated by the numeral 196 in FIG. 4. (In addition, the second hydraulic valve control assembly 196 has been schematically represented in FIG. 8 and such schematic representation has been designated by the numeral 196 in such Figure.) The second hydraulic valve control assembly 196 comprises a control rod 198 which is fixed to the piston rod 64 of the first hydraulic actuating cylinder 60 via a third mounting plate 200 that is attached to the piston rod 64 near the bearing 72 to support the control rod 198 in a substantially parallel relation to the piston rod 64 with the control rod 198 extending downwardly from the plate 200 to pass through an aperture 202 formed through the second mounting plate 108. Such mounting of the control rod 198 mechanically couples the control rod to the walking beam 32 to cause the control rod 198 to reciprocate through the aperture 202 as the walking beam 32 oscillates between the end positions of its pivotation arc as can be seen by a comparison of FIGS. 1 and 4.

A sleeve 204, slideably mounted on the control rod 198, is concurrently slideably mounted within the aperture 202 in the second mounting plate 108 for movement toward and away from the walking beam 32 and a pin 206 connects the sleeve 204 to the operating member 188 of the second hydraulic valve 170 so that movement of the sleeve 204 in the aperture 202 will shift the operating member 188 between the first and second positions thereof. In particular, the sleeve 204 can be moved to a lower sleeve position, shown in FIG. 7, to place the operating member 188 in the first position thereof and the sleeve 204 can be moved to an upper sleeve position, shown in FIGS. 4–6, to place the operating member 188 in the second position thereof.

Figure 5:
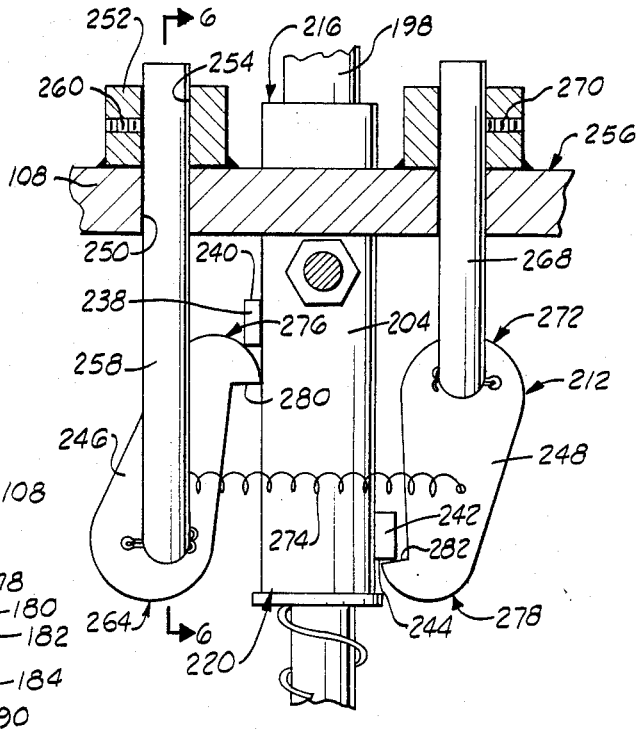
FIG. 5 is an end elevational view of the latch assembly of the hydraulic control circuit taken along line 5—5 of FIG. 4.
Figure 6:
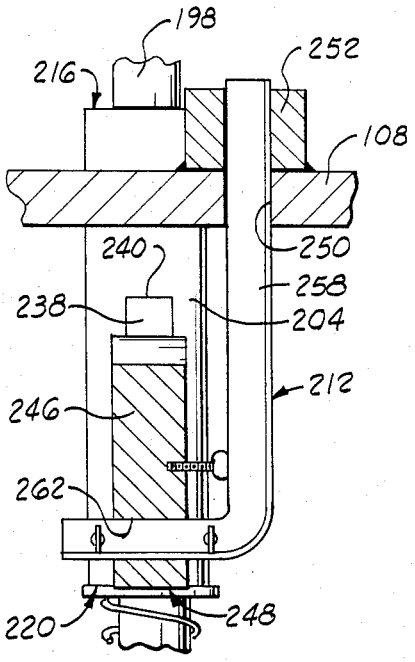
FIG. 6 is an elevational cross section of the latch assembly taken along line 6—6 of FIG. 5.
Figure 7:
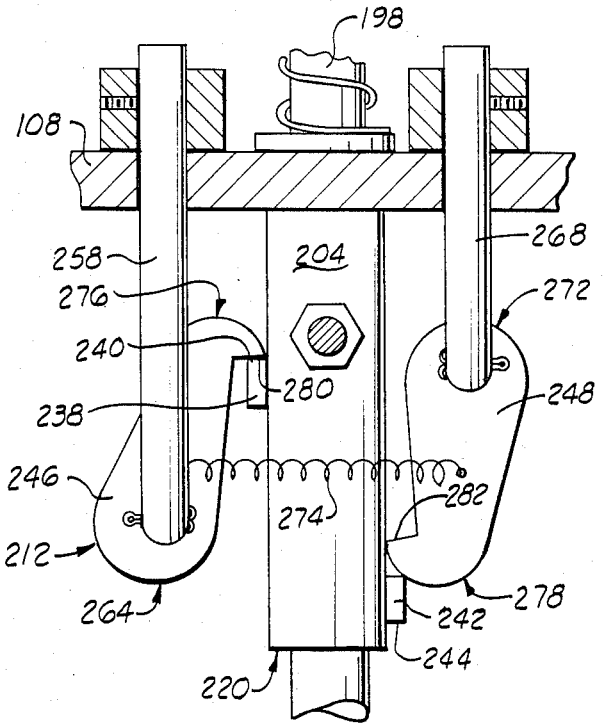
FIG. 7 is an elevational view of the latch assembly similar to FIG. 5 illustrating a second configuration of the latch assembly.
Figure 5:
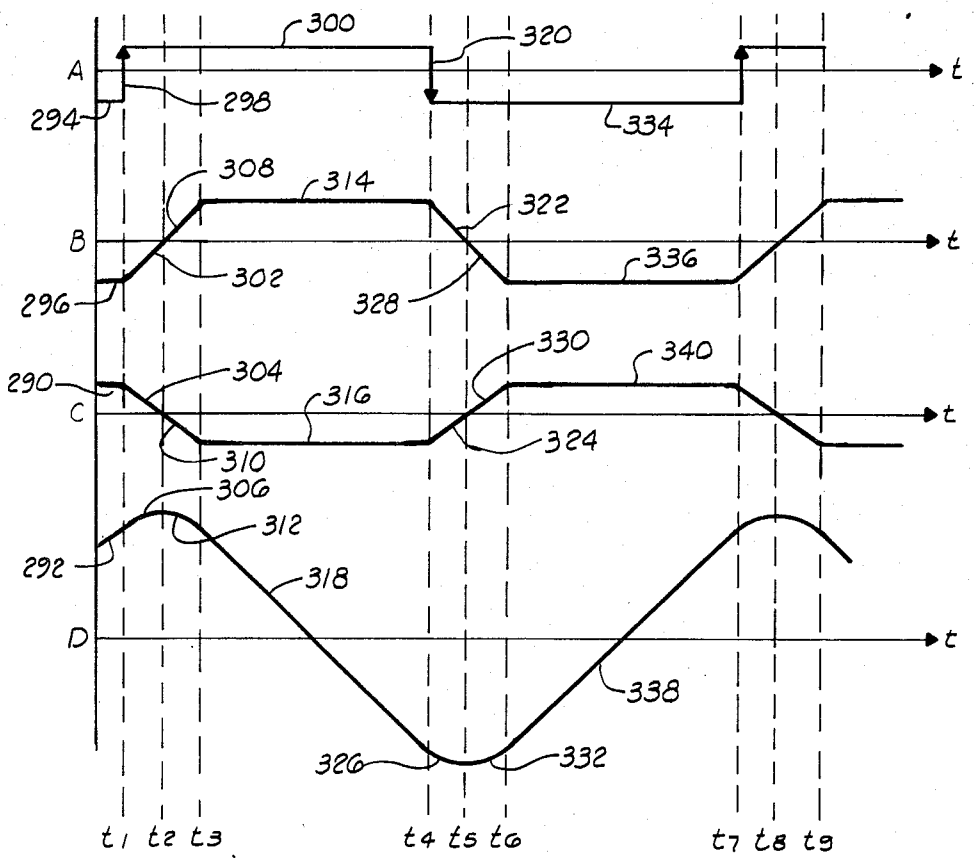
Figure 3:
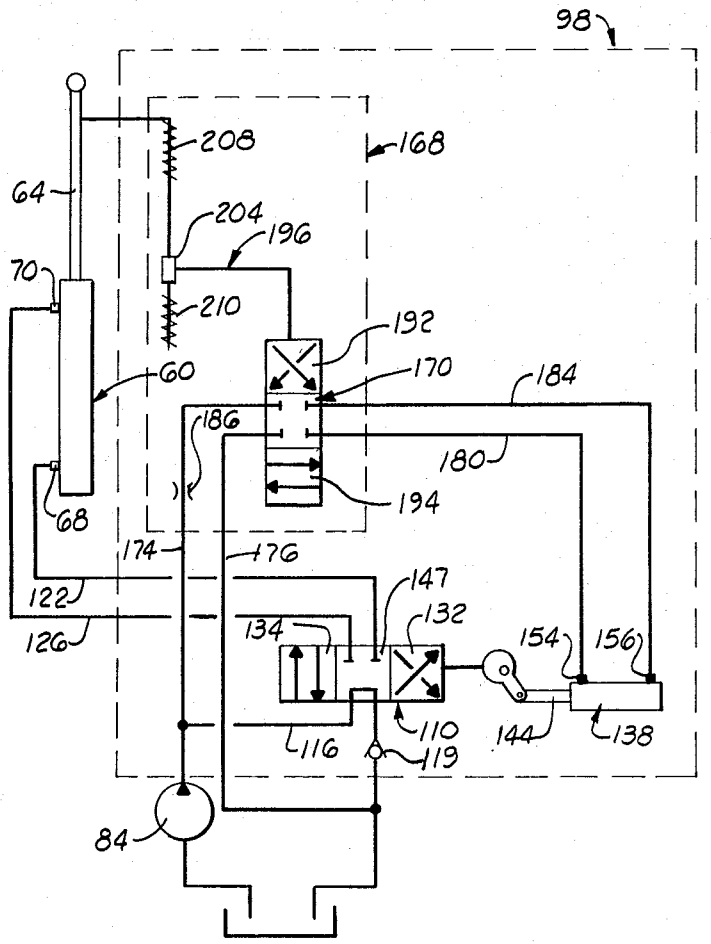

Movement of the sleeve 204 in the aperture 202 is effected by first and second sleeve engagement assemblies, 208 and 210 respectively, mounted on the control rod 198 to engage the sleeve 204 during oscillation of the walking beam 32, and consequent reciprocation of the control rod 198, and such movement is controlled by a latch assembly 212 particularly shown in FIGS. 5–7. In particular, the first sleeve engagement assembly 208 is mounted on the control rod 198 near the upper end 214 thereof to engage the upper end 216 of the sleeve 204; that is, the end of the sleeve 204 facing the walking beam 32, during each downward half cycle of oscillation of the walking beam 32 and the second sleeve engagement assembly 210 is similarly mounted on the control rod 198 near the lower end 218 thereof to engage the lower end 220 of the sleeve 204; that is, the end of the sleeve facing away from the walking beam 32, during each upward half cycle of oscillation of the walking beam 32. As will be discussed below, the latch assembly 212 holds the sleeve 204 in position between engagements of the sleeve 204 by the sleeve engagement assemblies 208, 210 and, further, insures that a shift of the sleeve 204 toward one of the positions thereof goes to completion in a manner and for a purpose to be discussed below.

The sleeve engagement assemblies are identical so that it will suffice for purposes of the present disclosure to describe only the first sleeve engagement assembly 208 in detail. As can be seen in FIG. 4, the first sleeve engagement assembly 208 comprises a compression spring 222 which is attached to a ring 224 that can be fixed on the control rod 198 via a set screw 226. The spring 222 extends from the ring 224 toward the sleeve 204 so that engagement of the sleeve 204 will tend to compress the spring 222 for a reason to be discussed below. A washer 228 can be fixed to the end of the spring 222 nearest the sleeve 204 to distribute the force between the spring and the sleeve 204 evenly about the upper end 216 of the sleeve 204. The second sleeve engagement assembly similarly comprises a spring 230, a ring 232, a set screw 234 and a washer 236 positioned near the lower end 218 of the control rod in the same manner that the components of the first sleeve engagement assembly 208 are positioned on the control rod 198 near the upper end 214 thereof.

Referring now to FIGS. 5–7, it will be seen therein that the sleeve 204 comprises a lug 238 near the upper end 216 of the sleeve 204 forming an upwardly facing shoulder 240 on one side of the sleeve 204 and a second lug 242 near the lower end 220 of the sleeve 204 forming a downwardly facing shoulder 244 on the opposite side of the sleeve 204. The latch assembly 212 comprises a first latch member 246 that is pivotally supported by the second mounting plate 108 to extend alongside the sleeve 208 in vertical alignment with the shoulder 240 of the sleeve 204 and a second latch member 248 that is pivotally supported by the second mounting plate 108 to extend alongside the sleeve 204 in vertical alignment with the shoulder 244 on the sleeve 204 so that the latch members 246 and 248 can engage the shoulders 240, 244 to hold the sleeve 204 in position on the second mounting plate 108.

For mounting the first latch member 246 on the second mounting plate 108, a bore 250 is formed through the second mounting plate 108 parallel to the aperture 202 and a ring 252, having a bore 254, is welded to the upper side 256 of the second mounting plate 108 to receive upper portions of a first latch member mounting rod 258. A set screw 260 mounted in a transverse bore formed in the ring 252 permits the first latch member mounting rod 258 to be secured to the second mounting plate 108 and positioned relative thereto, such that upper portions of the first latch member support rod 258 extend parallel to the sleeve 204. Lower portions of the first latch member support rod 258 are bent at a right angle, as shown in FIG. 6, to be pivotally received in a bore 262 formed through the first latch member 246 near the lower end 264 of the first latch member 246. The first latch member 246 can then be secured on the first latch member support rod 258 by cotter pins or the like as has been indicated in FIG. 6.

Similarly, the second latch member 248 is pivotally mounted on the second mounting plate 108 via a second latch member mounting rod 268 held in place by a set screw 270 in a second ring 272 welded to the second mounting plate 108, the second latch member mounting rod 268 similarly being bent at a right angle as shown in FIG. 4 to be received in a bore (not shown) formed through the second latch member 248 near the upper end 272 thereof. A spring 274 is connected between central portions of each of each the latch members 246, 248, so that the upper end 276 of the first latch member 246 and the lower end 278 of the second latch member 248 are biased against the sleeve 204 as shown in FIGS. 5–7. As is also shown in these Figures, a shoulder 280 is formed on the first latch member 246, near the upper end 276 thereof, to engage the shoulder 240 on the sleeve 204 when the sleeve 204 is the lower position thereof and a shoulder 282 is formed on the second latch member 248, near the lower end 278 thereof, to engage the shoulder 244 on the sleeve 204 when the sleeve 204 is in the upper position thereof shown in FIG. 5. The shoulders 280 and 282 are formed to engage the shoulders 240, 244 respectively on a slope so that the latch members 246, 248 releasably latch the sleeve 204 into the upper and lower positions, respectively, thereof. That is, the shoulder 280 will hold the sleeve 204 in the lower position against a limited force exerted on the lower end 220 of the sleeve 204, beyond which the upper end 276 of the first latch member 246 will pivot away from the sleeve 204, and the second latch member 248 similarly holds the sleeve 204 in the upper position thereof against a limited load on the upper end 216 of the sleeve 204. The springs 222 and 230 of the sleeve engagement assemblies 208 and 210 are selected to have a spring constant sufficient to overcome such limited load for a partial compression of the springs to provide for snap-action shifting of the control member 188 of the second hydraulic valve 170. That is, upon engagement between the upper end 216 of the sleeve 204, while the sleeve 204 is in the upper position thereof, and the first sleeve engagement assembly 208, the spring 222 will be initially compressed until the load on the upper end 216 of the sleeve 204 reaches the limited load for release of the first latch member 246. Subsequently, the first latch member pivots to release the sleeve 204 and the sleeve 204 is rapidly driven to the lower position thereof via the compression of the spring 222 to be latched into such lower position by the second latch member 248. A similar snap-action movement of the sleeve 204 will similarly occur when the lower end 220 of the sleeve 204 is engaged by the second sleeve engagement assembly 210. Such snap-action movement of the sleeve 204 between the upper and lower positions thereof enables the pump jack 10 to be operated, in a manner to be discussed below, at very low speeds to match conditions at a well to be pumped. In particular, and as will be discussed below, reversal of the direction of movement of the walking beam 32 is occasioned by slowly shifting the first hydraulic valve 110 through the neutral position of the operating member 128 thereof to initially slow the walking beam, bring the walking beam to a halt, and then slowly accelerate the walking beam in a reverse direction. The operating member 128 of the first hydraulic valve 110 is controlled by the second hydraulic actuating cylinder 138 which, in turn, is controlled by the second hydraulic valve 170. Should the operating member 188 of the second hydraulic valve be moved between the first and second positions thereof at the same speed that the walking beam moves during a reversal in the direction of movement of the walking beam, low speed operation of the pump jack 10 could result in a condition in which both hydraulic valves 110, 170 simultaneously reach a position in which fluid flow to the hydraulic actuating cylinders is discontinued and, should such situation occur, oscillation of the walking beam 32 would discontinue. By preventing such situation from occurring, the latch assembly 212 permits the pump jack 10 to be operated over a range of pumping rates including very low rates in which very few oscillations of the walking beam occur in a day's time. Thus, the pump jack 10 can be set to operate, via the control knob 94 on the pump 84, to operate at a cyclic rate that can be matched to characteristics of the well to be pumped. Similarly, the construction of the sleeve engagement assemblies 208, 219 permits the pivotation arc of the walking beam 32 during operation of the pump jack 10 to be selected to match individual well characteristics through the capability for positioning the sleeve engagement assemblies on the control rod 198 that is provided by securing the sleeve engagement assemblies to the control rod via the rings 224 and 232 and the set screws 226 and 234.

OPERATION OF THE PREFERRED EMBODIMENT

The operation of the pump jack 10 can best be understood by considering the states of the hydraulic actuating cylinders 60 and 138, the hydraulic valves 110 and 170, and the walking beam 32 as functions of time. Accordingly, FIG. 9 has been provided to indicate the extension of the operating member 188 of the second hydraulic valve 170 from the case 190 thereof (curve A), the extension of the piston rod 144 of the second hydraulic actuating cylinder 138 from the cylinder portions 142 thereof (curve B), the extension of the operating member 128 of the first hydraulic valve 110 from the case 130 thereof (curve C), and the extension of the piston rod 64 of the first hydraulic actuating cylinder 60 from the cylinder portion 62 thereof (curve D) for slightly more than one period of the cycle of operation of the pump jack 10. Since the first hydraulic actuating cylinder 60 is connected between the pump jack base 12 and the walking beam 32, it will be clear that the curve D also illustrates the angular position of the walking beam 32 on the samson post 24.

In each of the curves A through D of FIG. 9, time is plotted along the abscissa and the position of a valve operating member or a hydraulic actuating cylinder piston rod is plotted along the ordinate. In order to bring out the symmetry of operation of the components of the pump jack 10, the convention has been adopted in plotting the curves A through D that the position of a hydraulic valve operating member or a hydraulic actuating cylinder piston rod is zero at the midpoint of its travel between a fully retracted and a fully extended position, extensions beyond the midpoint are positive (above the time axis in FIG. 9) by an amount equal to the difference between the actual extension and the midpoint extension, and extensions less than midpoint extension are negative (below the time axis in FIG. 9) by an amount equal to the difference between the midpoint extension and the actual extension.

For purposes of discussion, it will be assumed that the walking beam is initially moving in the first direction 38 shown in FIG. 1 and is within an intermediate interval of its pivotation arc indicated at 284 in FIG. 1. For reasons that will become apparent from the description of the operation of the pump jack 10 to follow, the intermediate interval is characterized by a constant rate of pivotation of the walking beam 32 and such interval terminates a distance from each of the end positions of the walking beam 32. That is, adjacent the first end position of the walking beam 32 indicated by the dashed line 42 in FIG. 1 is a first transition interval 286 in which the rate of pivotation of the walking beam varies and, similarly, adjacent the second end position of the walking beam 32 indicated by the dashed line 44 in FIG. 1 is a second transition region 288 in which the pivotation rate of the walking beam also is variable.

Corresponding to the upward movement of the walking beam 32 in the intermediate interval 284, the operating member 128 of the first hydraulic valve 110 will be in the fully extended, or first, position thereof shown in FIG. 3 and such position is indicated by the portion 290 of the curve C in FIG. 9. With the operating member 128 of the first hydraulic valve 110 in such first position, the first section 132 (FIG. 8) of the spool of the first hydraulic valve 110 will be interposed between the output ports of the valve 110 and the input and exhaust ports thereof so that, as can be seen in FIG. 8, the pump 84 will be delivering pressurized hydraulic fluid to the first fluid port 68 of the first hydraulic actuating cylinder 60, via conduits 116 and 122 and the first section of the valve 132, and the piston rod 64 of the first hydraulic actuating cylinder will be extending to move the walking beam 32 toward the first end position thereof and to move the control rod 198 of the second hydraulic valve control assembly 196 in an upward direction. Such conditions of the first hydraulic actuating cylinder and the walking beam 32 have been indicated by the portion 292 of curve D in FIG. 9.

The sleeve 204, during the upward movement of the walking beam 32 in the intermediate interval 284 will be in the lower position thereof and the operating member 188 of the second hydraulic valve 170 will, consequently, be in the fully retracted, or first, position thereof, as indicated by the portion 294 of curve A in FIG. 9, so that the first section 192 of the spool of the second hydraulic valve 170 will be interposed between the output ports of the second hydraulic valve 170 and the input and exhaust ports thereof. Thus, as shown in FIG. 8, the first fluid port 154 of the second hydraulic actuating cylinder 138 will be in fluid communication with the pressure port 92 of the pump 84 via the first section 192 of the spool of the second hydraulic valve 170, the conduits 174 and 180, and the orifice 186. However, for a reason that will become clear below, the piston rod 144 of the second hydraulic actuating cylinder 138 will not be moving while the walking beam 32 is in the intermediate interval 284; rather, as indicated by the portion 296 of the curve B in FIG. 9, the piston rod 144 will be in a fully retracted position determined by the construction of the second hydraulic actuating cylinder 138 at such times that the walking beam is moving in the first direction 38 and the walking beam 32 is in the intermediate interval 284. That is, the piston of the second hydraulic actuating cylinder 138 will be in abutment with the end wall of the cylinder portion 142 adjacent the second end 150 thereof.

At a time slightly before the time $t_1$ indicated in FIG. 9, at which time the walking beam 32 will be slightly below the first transition interval 286, the second sleeve engagement assembly 210, being carried upwardly by the control rod 198, will engage the lower end 220 of the sleeve 204 and exert a force thereon tending to urge the sleeve 204 upwardly toward the walking beam 32. However, for reasons that will become clear below, the latch assembly 212 will be in the position shown in FIG. 7 so that the first latch member 246, engaging the shoulder 240 on the sleeve 204, will initially inhibit movement of the sleeve 204 upwardly. Thus, the engagement between the second sleeve engagement assembly 210 and the sleeve 204 will initially cause compression of the spring 230 of the second sleeve engagement assembly rather than movement of the sleeve 204. Such compression of the spring 230 will continue until the time $t_1$ in FIG. 9, corresponding to entry of the walking beam 32 into the first transition region 286, at which time the spring force on the lower end 220 of the sleeve 204 will exceed the limited force against which the latch assembly 212 can prevent movement of the sleeve 204. Thus, at the time $t_1$, the sleeve 204 undergoes a rapid displacement upwardly under the urging of the spring 230 of the second sleeve engagement assembly 210 so that the operating member 188 of the second hydraulic valve 170 undergoes a nearly instantaneous extension to the second position thereof as indicated by the portion 298 of curve A in FIG. 9. Simultaneously, the second latch member 248 engages the downwardly facing shoulder 244 on the sleeve 204 to maintain the sleeve 204 in the upward position shown in FIG. 5 and, consequently, to maintain the operating member 188 of the second hydraulic valve 170 in the second position thereof until a force is exerted on the upper end 216 of the sleeve 204. Such position is indicated by the portion 300 of the curve A in FIG. 9.

When the operating member 188 of the second hydraulic valve 170 is shifted to the second position thereof, the second section 194 of the spool of the second hydraulic valve 170 is interposed between the output ports of the valve 170 and the input and exhaust ports thereof to fluidly communicate the pressure port of the pump 84 to the second fluid port 156 of the second hydraulic actuating cylinder 138 via the hydraulic conduits 174 and 184 and the orifice 186 as can be seen from FIG. 8. Thus, a portion of the pressurized hydraulic fluid issuing from the pump 84 is transmitted to the second hydraulic actuating cylinder 60. Accordingly, the piston rod 144 of the second hydraulic actuating cylinder 138 will begin to extend, as indicated by the curve portion 302 of curve B in FIG. 9 to concurrently initiate a retraction of the operating member 128 of the first hydraulic valve 110 as indicated by the curved portion 304 of the curve C in FIG. 9. As the operating member 128 of the first hydraulic valve retracts, the proportioning characteristic of the first hydraulic valve 110 comes into play to divert an ever increasing proportion of the pressurized hydraulic fluid entering the input port 114 of the first hydraulic valve 110 to the exhaust port thereof, and thence to the fluid reservoir in the samson post 24, so that the rate of extension of the piston rod 64 of the first hydraulic actuating cylinder 60 will decrease as indicated by the portion 306 of the curve D in FIG. 9. (The rate at which fluid enters the port 114 is substantially equal to the pump flow rate despite the operation of the second hydraulic actuating cylinder 183 by the pump 84 by selecting the capacity of the cylinder 138 to be much smaller than the capacity of the first hydraulic actuating cylinder 60 and by choosing the orifice 186 to provide a high resistance to fluid flow to the second hydraulic actuating cylinder 138. Thus, the flow of hydraulic fluid to the second hydraulic actuating cylinder 138 has only a very small effect on the operation of the first hydraulic actuating cylinder 60 and the movement of the walking beam 32. Thus, for purposes of description of the operation of the pump jack 10, the flow of fluid to the second hydraulic actuating cylinder 138 can be ignored except as such flow determines the operation of the cylinder 138). That is, the diversion of pressurized hydraulic fluid to the exhaust port results in a decreasing rate of fluid flow to the first fluid port of the first hydraulic actuating cylinder 60. Such diversion of pressurized hydraulic fluid away from the first hydraulic actuating cylinder 60 will continue until the time $t_2$ in FIG. 9 at which point the piston rod 144 of the second hydraulic actuating cylinder 138 will have reached the midpoint of its range of travel to position the operating member 128 of the first hydraulic valve 110 such that the center section 147 of the first hydraulic valve will be positioned between the input and exhaust ports and output ports of the first hydraulic valve 110. In such a position, fluid flow reaching the input port 114 of the first hydraulic valve 110 will be diverted in its entirety to the exhaust port of the first hydraulic valve 110 so that the piston rod 64 of the first hydraulic valve 60 is brought slowly to rest in the time interval from $t_1$ to $t_2$ as indicated by the steadily decreasing slope of the portion 306 of curve D in FIG. 9. At the time $t_2$, the walking beam will, accordingly, reach the first end position indicated by the dashed line 42 in FIG. 1 at the outer end of the first transition interval 286 of the arc of travel of the walking beam on the samson post 24.

At the time $t_2$ that the walking beam reaches the first end position thereof, the piston rod 144 of the second hydraulic actuating cylinder 138 is only partially extended and, at the same time, the second section 194 of the second hydraulic valve 170 will remain interposed between the input and exhaust ports and the output ports of the second hydraulic valve 170 so that pressurized hydraulic fluid from the pump 84 will continue to be transmitted to the second fluid port 156 of the second hydraulic actuating cylinder 138 to continue the extension of the piston rod 144 thereof. (The check valve 119 by means of which fluid discharged from the exhaust port of the first hydraulic valve 110 is returned to the fluid reservoir in the samson post 124 insures that pressure will exist at the pressure port 92 of the pump 84 to continue the operation of the second hydraulic actuating cylinder 138.) Accordingly, the piston rod 144 of the second hydraulic actuating cylinder 138 will move past the midpoint of the range of travel thereof to continue movement toward a fully extended position, such movement being indicated by the portion 308 of curve B in FIG. 9. Such movement of the piston rod 144 of the second hydraulic actuating cylinder 138 will move the operating member 128 of the first hydraulic valve 110 away from the neutral position thereof so that the operating member 128 continues to retract as indicated by the portion 310 of curve C in FIG. 9. As the operating member 128 moves past the neutral position thereof, the second section 134 of the first hydraulic valve becomes interposed between the input and exhaust ports and output ports of the first hydraulic valve 110 so that pressurized hydraulic fluid is transmitted to the second fluid port 70 of the first hydraulic valve 60. However, because of the proportioning characteristic of the first hydraulic valve discussed above, only a portion of the pressurized hydraulic fluid delivered to the input port of the first hydraulic valve 110 will initially be transmitted to the second fluid port 70 of the first hydraulic actuating cylinder 60, such proportion increasing as the operating member 128 of the first hydraulic valve moves further away from the neutral position thereof. Accordingly, and as shown in the portion 312 of curve D in FIG. 9, pressurized hydraulic fluid will be delivered to the second fluid port 70 of the first hydraulic actuating cylinder 60 at an ever increasing rate to smoothly retract the piston rod 64 of the first hydraulic actuating cylinder from the maximum extended position of the piston rod 64 corresponding to the walking beam 32 being in the first position thereof indicated by the dashed line 42 in FIG. 1. Thus, and as indicated by the ever increasing slope of the portion 312 of curve D in FIG. 9, the walking beam 32 will be accelerated back through the first transition interval 286 in the second direction 40 of movement of the walking beam 32 on the samson post 24.

The movement of the walking beam 32 in the direction 40 and within the first transition interval 286 will continue until the time $t_3$ in FIG. 9, at which time the piston of the second hydraulic actuating cylinder 138 will abut the wall of the cylinder portion 132 of the hydraulic actuating cylinder 138 at the first end 146 of such cylinder portion 142. Accordingly, the transmission of pressurized hydraulic fluid to the second hydraulic actuating cylinder 138 will be discontinued at the time $t_3$ to cease further movement of the operating member 128 of the first hydraulic valve 110. The size of the cam 158 and the off center mounting of the cam 158 on the first mounting plate 106 are selected so that full extension of the piston rod 144 will place the operating member 128 of the first hydraulic valve 110 in the second position thereof wherein all pressurized hydraulic fluid entering the input port 114 is transmitted to the second output port 124 of the valve 110 to be further transmitted to the second fluid port 70 of the first hydraulic actuating cylinder 60. Accordingly, subsequent to the time $t_3$, and prior to a time $t_4$ indicated in FIG. 9, the piston rod 144 of the second hydraulic actuating cylinder 138 will remain fully extended as indicated by the portion 314 of curve B in FIG. 9; the operating member 128 of the first hydraulic valve 110 will remain fully retracted as indicated by the portion 316 of curve C in FIG. 9; and pressurized hydraulic fluid will be transmitted to the second fluid port 70 of the first hydraulic actuating cylinder 60 to cause a substantially constant retraction of the piston rod 64 of the first hydraulic actuating cylinder 60, determined by the substantially constant pumping rate of the pump 84, as indicated by the portion 318 of the curve D in FIG. 9.

At a time slightly before the time $t_4$ in FIG. 9, corresponding to a position of the walking beam 32 slightly above the second transition interval 288, the first sleeve engagement assembly 208 will engage the upper end 216 of the sleeve 204 to begin an initial compression of the spring 222 while the sleeve 204 is held in position by the second latch member 248. At the time $t_2$, corresponding to entry of the walking beam into the second transition interval 288, the force exerted on the upper end of the sleeve 204 will exceed the limited force against which the second latch member can hold the sleeve 204 in position to cause the sleeve 204 to rapidly move under the influence of the compressed spring 222 to the lower position of the sleeve shown in FIG. 7 where the latch assembly 212 will again latch the sleeve 204 in a fixed position. Such movement of the sleeve 204 causes a nearly instantaneous shift of the operating member 188 of the second hydraulic valve 170 to the first, retracted position thereof as indicated by the portion 320 of curve A in FIG. 9. With the shift of the operating member 188 of the second hydraulic valve 170 to the first position thereof, the first section 192 of the spool of the second hydraulic valve 170 is placed into a position between the ports of the second hydraulic valve 170 to fluidly connect the first fluid port 154 of the second hydraulic actuating cylinder 138 to the pressure port 196 of the pump 84. There thus occurs a reversal of the events that occurred following the time $t_1$ in FIG. 9 as will now be described.

When the first section 192 of the second hydraulic valve 170 is interposed between the ports of the second hydraulic valve 170, pressurized hydraulic fluid will be transmitted via the conduits 174 and 180, the orifice 186 and the first section 192 of the second hydraulic valve 170 to the first fluid port 154 of the second hydraulic actuating cylinder 138 so that the piston rod 144 of the second hydraulic actuating cylinder will commence to retract into the cylinder portion 144 of the second hydraulic actuating cylinder 138 as indicated by the portion 322 of the curve B in FIG. 9. Such retraction of the piston rod 144 of the second hydraulic actuating cylinder 138 will, via the coupling between the second hydraulic actuating cylinder 138 and the operating member 128 of the first hydraulic valve 110 provided by the cam 158 and the spring loading of the spool 131 of the first hydraulic valve 110, cause the operating member 128 of the first hydraulic valve 110 to commence extending as has been indicated by the portion 324 of the curve C in FIG. 9. Accordingly, the porportioning character of the first hydraulic valve 110, provided as discussed above, will come into play to commence a diversion of pressurized hydraulic fluid entering the input port 114 of the first hydraulic valve from the second output port 124 thereof to the exhaust port thereof so that, during the extension of the operating member 128 of the first hydraulic valve 110, pressurized hydraulic fluid will be delivered to the second fluid port 70 of the first hydraulic actuating cylinder 60 at an ever decreasing rate to cause a slowing of the retraction of the piston rod 64 of the first hydraulic actuating cylinder 60 as indicated by the portion 326 of the curve D in FIG. 9.

At the time $t_5$ in FIG. 9 at which the piston rod 144 of the second hydraulic actuating cylinder 138 reaches the midpoint of its range of travel, the operating member 128 of the first hydraulic valve 110 will reach the neutral position thereof such that all pressurized hydraulic fluid delivered to the input port 114 of the first hydraulic valve 110 will be diverted to the exhaust port of the first hydraulic valve 110 and thence, via the check valve 110, to the reservoir in the samson post 24. Accordingly, at the time $t_5$ in FIG. 9, the retraction of the piston rod 64 of the first hydraulic actuating cylinder 60 will cease, to discontinue movement of the walking beam 32, so that the walking beam 32 will have reached the second position indicated by the dashed line 44 in FIG. 1. As in the case of the stoppage of the walking beam 32 in its travel in the direction 38 during the time period from $t_1$ to $t_2$, the stoppage of the walking beam 32 in its travel in the direction 40 during the time period $t_4$ to $t_5$ will occur during a transition interval, such transition interval being the transition interval 288 in FIG. 1 and, further, such stoppage will occur smoothly as indicated by the ever increasing slope, to a slope of zero, of the portion 326 of the curve D in FIG. 9.

At the time $t_5$ that the walking beam 32 reaches the second end position indicated by the dashed line 44 in FIG. 1, the piston rod 144 of the second hydraulic actuating cylinder 138 will have retracted only to the midpoint of its range of travel and the first section 192 of the second hydraulic valve 170 will remain interposed between the ports of the valve 170 so that retraction of the piston rod 144 of the second hydraulic actuating cylinder will continue beyond the time $t_5$. Thus, the piston rod 144 will continue to retract as indicated by the portion 328 of the curve B in FIG. 9 to continue the extension of the operating member 128 beyond the neutral position thereof as indicated by the portion 330 of the curve C in FIG. 9. As the operating member 128 of the first hydraulic valve 110 moves beyond the neutral position thereof, the proportioning characteristic of the first hydraulic valve 110 comes into operation to commence the transmission of pressurized hydraulic fluid from the input port 114 of the first hydraulic valve to the first output port 120 thereof, initially with major portions of such fluid being transmitted to the exhaust port of the valve 110, so that pressurized hydraulic fluid will commence to flow into the first fluid port 68 of the first hydraulic actuating cylinder 60 via the conduit 122 by means of which the first fluid port 68 of the first hydraulic actuating cylinder 60 is connected to the output port 120 of the first hydraulic valve 110. Thus, the piston rod 64 of the first hydraulic actuating cylinder will commence to extend as indicated by the portion 332 of the curve D in FIG. 9 and such extension will occur at an ever increasing rate until the piston rod 144 of the second hydraulic actuating cylinder 138 becomes fully retracted. That is, while the piston rod 144 of the hydraulic actuating cylinder is retracting, the operating member 128 of the first hydraulic valve will move in the direction 137 between the neutral position thereof toward the first end position thereof so that the proportioning characteristic of the first hydraulic valve will divert pressurized hydraulic fluid from the input port 114 of the first hydraulic valve 110 to the exhaust port thereof and from the first output port 120 thereof at an ever decreasing rate. At the time $t_6$ the piston rod 144 of the second hydraulic actuating cylinder 138 will reach the maximum retraction of which the piston rod 144 is capable, as determined by the construction of the second hydraulic actuating cylinder 138, and will subsequently remain so maximally retracted until a time $t_7$ in FIG. 9 as indicated by the portion 336 of the curve B in FIG. 9. The circular construction of the cam 158 and the off center mounting of such cam are selected such that, with maximal retraction of the piston rod 144 of the second hydraulic actuating cylinder 138, the operating member 128 of the first hydraulic valve will be in the maximally extended first position thereof indicated in FIG. 3 so that, between the times $t_6$ and $t_7$, all pressurized hydraulic fluid delivered by the pump 84 will be transmitted to the input port 114 of the first hydraulic valve 110 and thence to the first fluid port 68 of the first hydraulic actuating cylinder 60 so that the piston rod 64 of the first hydraulic actuating cylinder 60 will extend at a substantially constant rate. That is, from the time $t_5$ until the time $t_7$, the walking beam 32 will initially be driven through the second transition interval 288 in the direction 38 in FIG. 1 (from time $t_5$ to time $t_6$) and thereafter will enter the intermediate interval 284 (at time $t_6$) and continue moving in the direction 38 at substantially constant speed until the walking beam 32 again enters the first transition interval 286 at time $t_7$.

The events occurring at times $t_1$, $t_2$ and $t_3$ are then repeated at times $t_7$, $t_8$ and $t_9$ in FIG. 9 and further repetitions and reversals of these events occur at later times so that the walking beam oscillates between the first and second end positions indicated by the dashed lines 42 and 44 respectively in FIG. 1. During each transition interval, 286 and 288, the fluid flow entering the input port of the first hydraulic valve is proportioned between the hydraulic actuating cylinder 60 and the fluid reservoir in the samson post 24 and, moreover, such proportioning within each interval and for both directions of movement of the walking beam 32 therein is such that the supply of pressurized hydraulic fluid to the first hydraulic actuating cylinder 60 is proportional to the displacement of the walking beam 32 from the end point adjacent the transition interval within which the walking beam is disposed with the result that the walking beam 32 is slowly brought to rest within each transition interval and then accelerated from rest in the opposite direction. Such proportionality follows from the proportioning characteristic of the first hydraulic valve 110 provided as has been described above. Between the transition intervals; that is, within the intermediate interval 284, the entire output of the pump 84 is delivered to the first hydraulic actuating cylinder 60, because of the positioning of the spool 131 of the first hydraulic valve 110 and the abutment of the piston of the second hydraulic actuating cylinder 138 with an end wall of the cylinder portion 142 thereof, so that the walking beam 32 pivots at a substantially constant rate, for either direction of movement of the walking beam 32, in the intermediate interval 284. Thus, as depicted in curve D of FIG. 9, for the piston rod 64 to which the walking beam 32 is connected, the piston rod 64 and walking beam 32 undergo substantially harmonic motion.

It has been noted above that the end positions of the walking beam 32 can be selected by selecting the positions of the sleeve engagement assemblies 208, 210 on the control rod 198 and the cyclic rate of operation of the pump jack 10 can be selected via the control knob 94 on the pump 84. In addition to these selection capabilities, the pump jack 10 is provided with a selection capability with regard to the lengths of the transition intervals 286, 288 and the intermediate interval 284 by the selection of the orifice 186 and the selection of the lengths of the springs 222 and 230 of the sleeve engagement assemblies 208, 210. That is, the lengths of the springs and the positioning of the sleeve engagement assemblies determines the positions at which the walking beam enters each transition interval 286, 288 and the selection of the orifice determines the lengths of such transition intervals by determining the distance the walking beam 32 will move as the second hydraulic actuating cylinder 138 moves the operating member 128 of the first hydraulic valve 110 to the neutral position thereof. Accordingly, the present invention provides a pump jack which can be caused to operate over a selectable range of oscillation of the walking beam thereof, at a selectable rate of oscillation of the walking beam thereof, and with a form of motion selectable to approximate harmonic motion to substantially any degree desired by the user of the pump jack.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. A pump jack, comprising:

a pump jack base;

a walking beam pivotally mounted on the pump jack base for oscillation in a vertical arc between first and second end positions of the walking beam;

pumping means including a fluid reservoir for providing a source of pressurized hydraulic fluid at a substantially constant flow rate, the pressurized hydraulic fluid being supplied at a pressure port of the pumping means;

a first hydraulic actuating cylinder connected between the walking beam and the pump jack base for pivoting the walking beam in a first direction toward the first end position of the walking beam in response to pressurized hydraulic fluid received at a first fluid port of the first hydraulic actuating cylinder and for pivoting the walking beam in a second direction toward the second end position of the walking beam in response to pressurized hydraulic fluid received at a second fluid port of the first hydraulic actuating cylinder;

a first hydraulic valve having an input port fluidly connected to the pressure port of the pumping means, an exhaust port connected to the fluid reservoir, a first output port fluidly connected to the first fluid port of the first hydraulic actuating cylinder, and a second output port fluidly connected to the second fluid port of the first hydraulic actuating cylinder, the first hydraulic valve having an operating member movable to a first position to internally fluidly connect the input port of the first hydraulic valve to the first output port thereof and movable to a second position to internally fluidly connect the input port of the first hydraulic valve to the second output port thereof, wherein the first hydraulic valve is characterized as being of the type wherein the operating member thereof is disposable in a neutral position between said first and second positions of said operating member of the first hydraulic valve to block fluid flow through the first hydraulic valve and wherein the first hydraulic valve is further characterized as being of the type having means providing fluid proportioning characteristics at such times that the operating member of the first hydraulic valve is positioned between the neutral position and an end position thereof for transmitting pressurized hydraulic fluid from the input port of the first hydraulic valve to an output port thereof in proportion to the displacement of the operating member thereof from the neutral position of the operating member;

a second hydraulic actuating cylinder having a piston rod mechanically coupled to the operating member of the first hydraulic valve for moving the first hydraulic valve operating member to the first position thereof in response to pressurized hydraulic fluid received at a first fluid port of the second hydraulic actuating cylinder and for moving the first hydraulic valve operating member to the second position thereof in response to pressurized hydraulic fluid received at a second fluid port of the second hydraulic actuating cylinder;

a second hydraulic valve having an input port fluidly connected to the pressure port of the pumping means, a first output port fluidly connected to the first fluid port of the second hydraulic actuating cylinder, and a second output port fluidly connected to the second fluid port of the second hydraulic actuating cylinder, the second hydraulic valve having an operating member movable to a first position to internally connect the second hydraulic valve input port to the second hydraulic valve first output port and movable to a second position to internally connect the second hydraulic valve input port to the second hydraulic valve second output port; and second hydraulic valve control means mechanically coupling the operating member of the second hydraulic valve to the walking beam for moving the second hydraulic valve operating member to the second position thereof during pivotation of the walking beam toward the first end position thereof and for moving the second hydraulic valve operating member to the first position thereof during pivotation of the walking beam toward the second end position thereof, the second hydraulic valve control means comprising:

a mounting plate disposed below a portion of the walking beam;

a sleeve mounted on the mounting plate for axial movement along a substantially vertical axis between upper and lower sleeve positions, said sleeve having an upper end facing the walking beam and a lower end facing away from the walking beam;

a control rod mechanically coupled to the walking beam and passing through the sleeve for substantially vertical reciprocation through said sleeve in coordination with the oscillation of the walking beam;

first sleeve engagement means mounted on the control rod above said sleeve for engaging the upper end of the sleeve and forcing the sleeve downwardly during one half cycle of the reciprocation of the control rod through the sleeve; and second sleeve engagement means mounted on the control rod below said sleeve for engaging the lower end of the sleeve and forcing the sleeve upwardly during the other half cycle of the reciprocation of the control rod through the sleeve;

wherein the second hydraulic valve is mounted on the mounting plate and positioned thereon relative to said sleeve for movement of the operating member of the second hydraulic valve between said first and second positions thereof along a line parallel to the axis of the sleeve; and wherein said sleeve is connected to the operating member of the second hydraulic valve for shifting the second hydraulic valve operating member between said first and second positions thereof.

2. The pump jack of claim 1 wherein the pumping means is characterized as comprising a variable displacement pump for providing pressurized hydraulic fluid at a selectable, substantially constant flow rate and means for driving said pump.

3. The pump jack of claim 1 further comprises an orifice disposed in the fluid connection between the pumping means pressure port and the second hydraulic valve input port to select the rate of flow of pressurized hydraulic fluid from the pumping means to the second hydraulic valve.

4. The pump jack of claim 1 wherein each of the first and second sleeve engagement means is characterized as being selectively positionable along said control rod.

5. The pump jack of claim 1 wherein the second hydraulic valve control means further comprises releasable latch means for holding the sleeve in each of the upper and lower positions thereof against a limited load urging the sleeve from one of the upper and lower positions to the other of the upper and lower positions of the sleeve; and wherein each of the first and second sleeve engagement means comprises a compression spring positioned fon compression via engagement of the sleeve engagement means with one end of the sleeve, the spring of each sleeve engagement means having a spring constant sufficient to overcome said limited load for partial compression of the spring.

6. The pump jack of claim 5 wherein an upwardly facing shoulder is formed on the sleeve near the upper end thereof and a downwardly facing shoulder is formed on the sleeve near the lower end thereof; and wherein the latch means comprises:

a first latch member extending along one side of the sleeve, the first latch member pivotally supported near the lower end thereof by the second mounting plate and the first latch member having a shoulder near the upper end thereof to slopingly engage the upwardly facing shoulder on the sleeve in the lower position of the sleeve on the second mounting plate;

a second latch member extending along an opposite side of the sleeve, the second latch member pivotally supported near the upper end thereof by the second mounting plate and the second latch member having a shoulder near the lower end thereof to slopingly engage the downwardly facing shoulder on the sleeve in the upper position of the sleeve on the second mounting plate; and a spring connected between the latch members to bias the upper end of the first latch member and the lower end of the second latch member against the sleeve.

7. The pump jack of claim 1 wherein the first hydraulic valve is characterized as being of the type wherein the operating member thereof is internally biased for displacement in the first direction from the neutral position and wherein the pump jack further comprises:

a further mounting plate whereon the first hydraulic valve and the second hydraulic actuating cylinder are mounted; and a cam pivotally mounted on the further mounting plate to engage the operating member of the first hydraulic valve, the cam being positioned on the line of movement of the operating member of the first hydraulic valve and in the first direction of the operating member of the first hydraulic valve from the neutral position thereof, the cam having an arm extending radially from the pivotation axis of the cam on the further mounting plate, and said arm attached to the piston rod of the second hydraulic actuating cylinder to mechanically couple the operating member of the first hydraulic valve, to the piston rod of the second hydraulic actuating cylinder.

8. The pump jack of claim 1 wherein the first hydraulic actuating cylinder comprises a cylinder portion pivotally connected at one end thereof to the pump jack base and a piston rod telescopically received in the other end thereof, the extensive end of the piston rod pivotally connected to the walking beam; wherein the mounting plate is mounted on the cylinder portion of the first hydraulic actuating cylinder; and wherein the control rod is secured to the piston rod of the first hydraulic actuating cylinder to mechanically couple the control rod to the walking beam.

* * * * *

UNITED STATES PATENT AND TRADEMARK OFFICE

CERTIFICATE OF CORRECTION

PATENT NO. : 4,534,168

DATED : August 13, 1985

INVENTOR(S) : Newby O. Brantly

It is certified that error appears in the above-identified patent and that said Letters Patent is hereby corrected as shown below:

Column 1, line 33, the word "horehead" should be --horsehead--.

Column 23, line 9, the word "fon" should be --for--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*